US005495644A

United States Patent [19]

Mesher et al.

[11] Patent Number: 5,495,644

[45] Date of Patent: Mar. 5, 1996

[54] ORNAMENTAL GRIPPING DEVICE FOR HOLDING GIFT CARDS ONTO GIFT PACKAGES

[76] Inventors: James A. Mesher, 4800 Phinney Ave., N., #4, Seattle, Wash. 98103; Ofra R. Haviv-Levy, 7600 SE. 29th St., #101, Mercer Island, Wash. 98040

[21] Appl. No.: 259,490

[22] Filed: Jun. 14, 1994

[51] Int. Cl.[6] ..... B42F 1/00; A44B 21/00

[52] U.S. Cl. ..... 24/3.12; 24/16 R; 24/67.9; 24/304; 24/545

[58] Field of Search ..... 24/304, 447, 693, 24/545, 563, 564, 570, 487, 530, 67.9, 3 L, DIG. 11; 248/205.3

[56] References Cited

U.S. PATENT DOCUMENTS

| | | | |
|---|---|---|---|
| 1,756,216 | 4/1930 | Seeley | 24/DIG. 11 |
| 2,368,838 | 2/1945 | James | 248/205.3 |
| 3,797,076 | 3/1974 | Watkin | 24/67.9 |
| 3,983,602 | 10/1976 | Barry | 24/11 R |
| 4,003,538 | 1/1977 | Frye | 248/467 |
| 4,056,139 | 11/1977 | Murt | 150/39 |
| 4,148,114 | 4/1979 | Wier | 24/67.9 |
| 4,253,216 | 3/1981 | Brown | 24/67 AR |
| 4,716,634 | 1/1988 | Fan | 24/545 |
| 4,903,376 | 2/1990 | Rousseau | 244/67.9 |
| 4,947,524 | 8/1990 | Chang | 24/67.9 |
| 4,967,453 | 11/1990 | MacDonald | 24/530 |
| 4,991,268 | 2/1991 | Ho | 24/67.3 |
| 5,010,629 | 4/1991 | Hirzel | 24/67.9 |
| 5,056,197 | 10/1991 | Cohen | 24/304 |
| 5,184,375 | 2/1993 | Hoyt | 24/3 L |
| 5,331,721 | 7/1994 | Raum, Sr. | 24/3 L |

FOREIGN PATENT DOCUMENTS

| | | | |
|---|---|---|---|
| 2155094 | 9/1985 | United Kingdom | 24/67.9 |

*Primary Examiner*—Victor N. Sakran

*Attorney, Agent, or Firm*—Dean A. Craine; Craine & Jackson

[57] ABSTRACT

A combination ornamental and gripping device (30), designed especially to allow a novel and improved method for securely holding a flat object (10) such as a gift card or the like to a gift package (20) while providing ornamentation for the gift package (20). The gripping device (30) is preferably a single piece of molded or extruded resilient plastic material and is essentially U-shaped with two side members (32 and 34) that are of similar size and shape and that are essentially planar. The outside face of the ornamental side member (32) typically has a multi-colored design and/or message bonded to it as an ornamental member (46), or integrally molded with it, or printed on it. The outside face of the attaching side member (34) has applied to it an adhesive layer (38) with a peelable, protective liner (40), and is used to attach the gripping device (30) to the gift package (20). The side members (32 and 34) are biased so as to urge resiliently toward one another, thereby providing a clamping pressure to firmly hold the inserted flat object (10). Clamping pressure is preferably increased by providing two laterally oriented, rounded ridges or protrusions (42 and 44), with one on either side member (32 or 34), and positioned in an offset arrangement. Either protrusion is of such a size and protrudes toward the opposite side member to such an extent that the inserted flat object (10) is held with an increased clamping pressure so as to be securely, yet releasably, retained. At the open end of the gripping device (30), the gap between the side members (32 and 34) is wider, so as to facilitate insertion of the flat item (10) to be secured.

6 Claims, 5 Drawing Sheets

ORNAMENTAL GRIPPING DEVICE FOR HOLDING GIFT CARDS ONTO GIFT PACKAGES

BACKGROUND

1. Field of Invention

This invention relates to devices and methods for releasably securing and retaining flat objects to other objects and, more particularly, it relates to a novel gripping device which is a combined securement and aesthetic-enhancement device and which effects, in a novel way, both securement of a gift card and the like to the outside of a gift package and ornamentation of a gift package.

2. Description of Prior Art

The formal exchange of gifts is a universal and ongoing ritual which is repeated throughout each year on numerous occasions, i.e., birthdays, Christmas, Valentine's Day, weddings, anniversaries, graduation, etc., in virtually every community in virtually every country in the world. Also universal, is the practice of presenting a gift in such a way that the gift is boxed or otherwise packaged. The box or package, or the gift itself, is usually concealed and ornamented by wrapping with paper or tissue which is manufactured for this purpose. Further ornamentation is then often provided by the application of ribbons, bows, adhesively applied stickers and other ornamental objects. Because of the ongoing and widespread use of such gift packaging and ornamentation products, a substantial, multinational industry has evolved to create and sell such products. Gift wrapping paper and tissue is available in a variety of designs, patterns, textures, and colors. The same can be said for the ribbons, bows, and other forms of ornamentation which are available.

It is notable that, despite the above facts, there remains a fundamental void in the line of products available for gift packaging and ornamentation. Usually, when a gift is given, it is accompanied by a gift card which is typically enclosed in an envelope. The basic fraction of such a card is to convey a written message in an aesthetically pleasing form to the person(s) receiving the accompanying gift. It is desirable to the person(s) giving the card and accompanying gift that the card be perused immediately before the gift package is opened. It is therefore customary for the card to be attached to the gift package. It is often the case that a gift is not immediately opened by the person(s) receiving the gift or in the presence of the person(s) giving the gift. For example, many gifts from various persons may be left under a Christmas tree to be opened later by various persons, or, many gifts from various persons may be placed together at a wedding reception to be later opened by the bride and groom. It is, therefore, a highly desirable dual function of a gift card to both convey a message to the recipient(s) of an accompanying gift package immediately before the gift package is opened, as discussed above, and to simply allow those recipients to know who the gift is from. It follows that it is highly desirable to attach a gift card to a gift package in a secure fashion. This is generally appreciated by persons when they give gifts. The universal solution to the problem of securely attaching a gift card to a gift package is to use cellophane tape or the like. It is remarkable that, despite the existence for many years in the prior art of a variety of practical, elegant, and aesthetically enhancing products for the wrapping and ornamentation of gift packages and despite the commonly occurring and strong need to releasably secure a gift card to a gift package, there does not exist in the prior art a more elegant or aesthetically enhancing and practical means for such securement. Instead, the prior art compels persons giving gifts to typically resort to the use of cellophane tape or the like.

The use of cellophane and other forms of tape to secure a gift card and the like to a gift package suffers from a number of disadvantages:

(a) The tape does nothing to aesthetically enhance the appearance of the gift package.

(b) The tape does, in fact, serve to diminish the aesthetic quality of the appearance of the gift package.

(c) The use of tape often does not allow the gift card to be readily removed from the gift package without causing defacement of the card itself, if the card is not contained in an envelope, or without damaging the envelope in which the card may be placed. This is particularly undesirable when one wishes to save the card and envelope.

(d) The tape does not necessarily securely attach the gift card or the like to a gift package, especially when only one edge of the gift card is taped to the package, thereby allowing the card to flip and twist and become dislodged from the package; and especially when the tape is not applied in such a manner that there is sufficient adhesive contact area between it and either the card or the package.

(e) The tape does not eliminate the need to use or expense of using other forms of ornamentation for a gift package, such as multicolored gift wrap, ribbon, bows, and the like.

(f) The tape does not eliminate the skill and time required to use other forms of ornamentation for a gift package, such as multicolored gift wrap, ribbon, bows, and the like.

As an alternative to using cellophane tape or the like, one will sometimes attempt to wedge a gift card or the like between the gift package and ribbon or other decorative string which may be encircled about the package. This generally is not a satisfactory method for securely attaching the card to the package as it is very difficult to apply the ribbon or string tight enough around the package. The result is that the card slips out and becomes separated from the package.

Several types of releasably holding or gripping devices have been proposed for various purposes—for example, in U.S. Pat. No. 3,983,602 to Barry (1976), U.S. Pat. No. 4,003,538 to Frye (1977), U.S. Pat. No. 4,056,139 to Murt (1977), U.S. Pat. No. 4,253,216 to Brown (1981), U.S. Pat. No. 4,903,376 to Rousseau (1990), U.S. Pat. No. 4,967,453 to MacDonald (1990), U.S. Pat. No. 4,991,268 to Ho (1991), and U.S. Pat. No. 5,184,375 to Hoyt (1993). However, none of these devices is suitable as a way to releasably secure a gift card and the like to a gift package.

SUMMARY OF THE INVENTION

Objects and Advantages

It will be readily appreciated by the reader from the description below of the present invention that one reason for the above mentioned void in the prior art is that, despite the plethora of clips and other holding and securement devices for flat objects such as cards, none possess the unique combination of elements of the present invention.

Accordingly, several objects and advantages of the present invention are:

(a) to provide a gripping device which can be used to attach a gift card and the like to the outside of a gift package in a novel way which serves as an alternative to the use of cellophane tape and the like for such purposes;

(b) to provide a gripping device capable of the use described in paragraph (a) and which can be inexpensively manufactured and, therefore, be affordable as a disposable item;

(c) to provide a gripping device capable of the use described in paragraph (a) and which can be easily and securely attached to the outside of a gift package;

(d) to provide a gripping device capable of the use described in paragraph (a) and which is designed so as to allow easy insertion of a gift card or like item into the gripping device after attachment of the gripping device to a gift package and which, thereby, securely attaches the gift card to the package and, yet, which allows easy removal of the gift card or the like from the gripping device;

(e) to provide a gripping device capable of the use described in paragraph (a) and which is designed to allow for removal of a gift card and the like without defacing or otherwise damaging the same;

(f) to provide a gripping device capable of the use described in paragraph (a) and which not only attaches a gift card to a gift package, as described above, but also aesthetically enhances and adds significance to a gift package through incorporation onto the gripping device of either a purely ornamental design or a functional design which might, for example, include the message "Happy Birthday" or "Happy Valentine's Day";

(g) to eliminate the disadvantages of using cellophane tape and the like for securement of gift cards and the like to gift packages. Such disadvantages include: diminishing the aesthetic quality of the gift package, defacement and damaging of gift cards and envelopes when the tape is removed, failure to securely hold gift cards and the like to gift packages when tape is improperly applied or only applied to one edge of such cards and the like, and failure to eliminate the need for and expense of other forms of ornamentation;

(h) to eliminate the need for and accompanying expense of ribbon and bows and other forms of ornamentation for gift packages by providing ornamentation as part of the gripping device itself;

(i) to eliminate much of the time that is required to ornament a gift package using present means, such as ribbon and bows, by providing a gripping device that is capable of the use described in paragraph (a) and that provides a quick means of ornamenting a gift package;

(j) to eliminate much of the skill that is required to ornament a gift package using present means, such as ribbon and bows, by providing a gripping device that is capable of the use described in paragraph (a) and that provides an easy means of ornamenting a gift package;

(k) to provide a novel form of ornamentation to a gift package, whereby the ornamentation is not crushed or otherwise damaged, such as a bow might be, when the gift package is wrapped with mailing paper and shipped or otherwise stacked with other gift packages;

(l) to provide a novel method for attaching gift cards and the like to the outside of gift packages which is superior to present methods.

Further objects and advantages are to provide a gripping device which can be easily manufactured in a multitude of colors and in a multitude of sizes and shapes and incorporating a multitude of designs and messages which would be appropriate to the occasions prompting the giving of gift packages to which the gripping device is applied.

To achieve the foregoing objects and advantages, and in accordance with the present invention, provided is a gripping device which is essentially planar and inexpensively manufactured in a variety of shapes and sizes and colors of plastic material. Provided is a gripping device which readily accepts and securely holds a flat object such as a gift card and, yet, readily releases such a flat object. Provided is a gripping device which includes a layer of adhesive material on one side, for attachment of the gripping device to a gift package, and an ornamental and/or functional design on the other side, which is visible above an inserted flat object.

BRIEF DESCRIPTION OF THE DRAWINGS

The present invention will be better understood and the objects and advantages set forth above will become more apparent when consideration is given to the following detailed description of a preferred but nonetheless illustrative embodiment of the present invention. Also described are several alternate embodiments of the present invention. These descriptions make reference to the annexed drawings in which closely related figures have the same number but different alphabetic suffixes and in which like reference numerals refer to like parts throughout the several views, and in which.

Reference Numerals in Drawings

Figure 1:
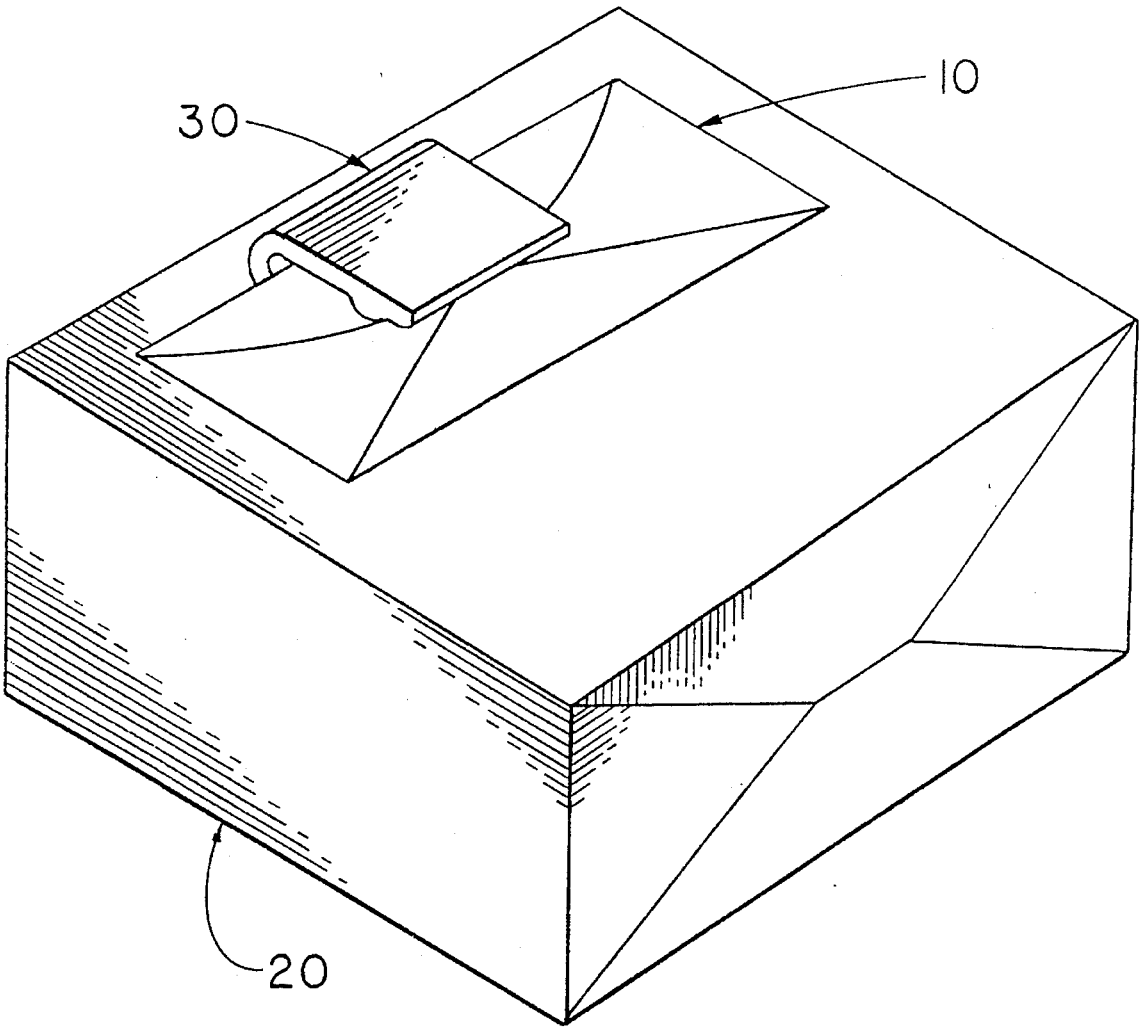
FIG. 1 is a perspective view of the device of FIG. 2 showing one example of an intend use in which the device is attached to a gift package and holds an inserted gift card, thereby attaching the same to the gift package.

| | | | |
|---|---|---|---|
| 10 | flat object | 20 | gift package |
| 30 | preferred embodiment of gripping device | 32 | ornamental side member of preferred embodiment |
| 34 | attaching side member of preferred embodiment | 36 | integral joint at closed end of preferred embodiment |
| 38 | adhesive layer | 40 | peelable liner |
| 42 | protrusion on ornamental side member 32 | 44 | protrusion on attaching side member 34 |
| 46 | ornamental member | 50 | alternate embodiment of gripping device |
| 52 | ornamental side member of alternate embodiment | 54 | non-ornamental side member of alternate |

-continued

| Reference Numerals in Drawings | | | |
|---|---|---|---|
| | | | embodiment |
| 56 | counteractive fulcrum means | 58 | upper wall member of counteractive fulcrum means |
| 60 | lower wall member of counteractive fulcrum means | 62 | closed end of counteractive fulcrum means |
| 64 | non-adhesive attachment means | | |

DETAILED DESCRIPTION OF THE PREFERRED EMBODIMENT

Figure 2:
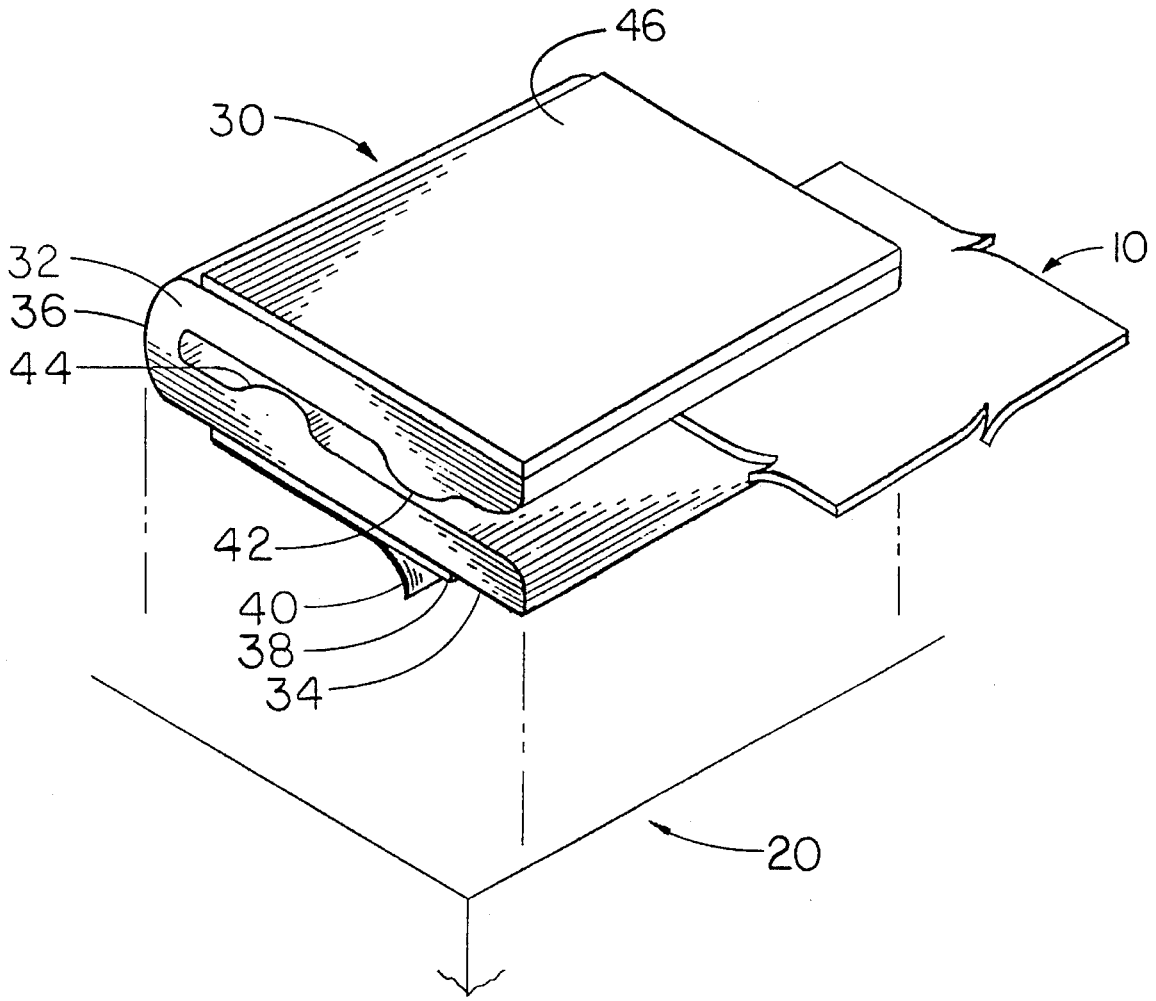
FIG. 2 is a perspective view looking from the ornamental face of the preferred embodiment of the releasably securing and retaining gripping device constructed in accordance with the present invention.
Figure 3:
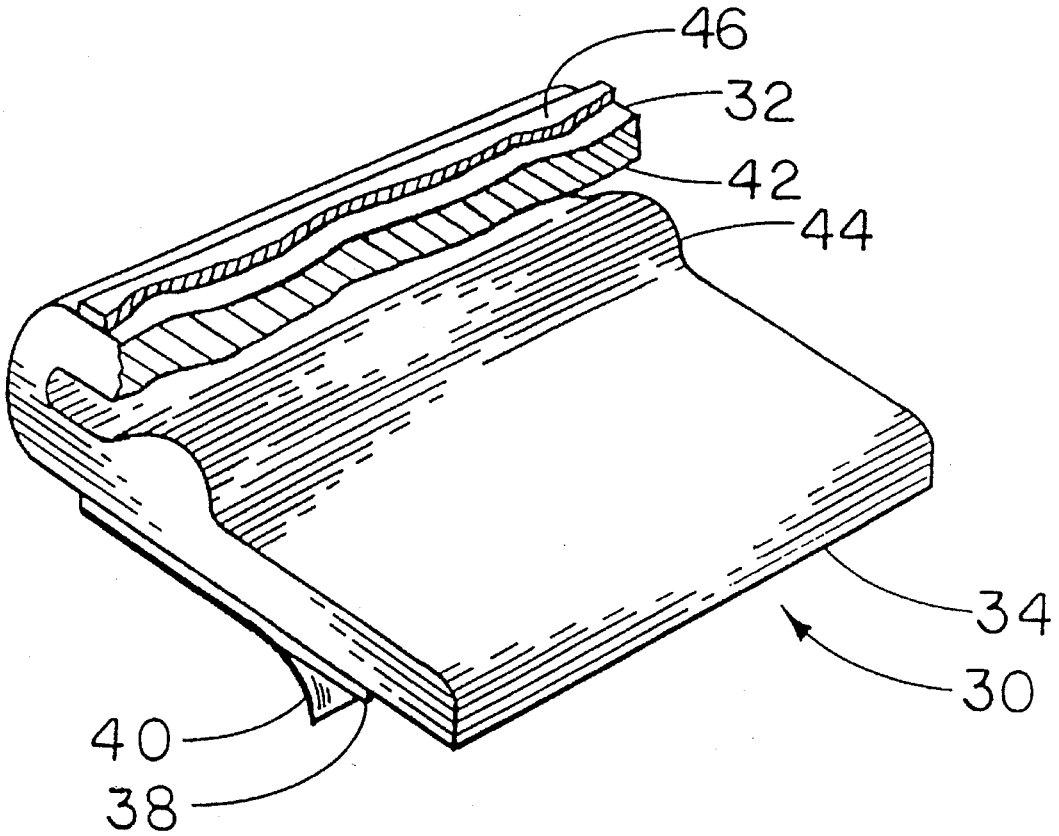
FIG. 3 is a perspective view looking from the ornamental face of the device of FIG. 2 with the ornamental side member shown in section to reveal the interior structure of the attaching side member of the device.
Figure 4:
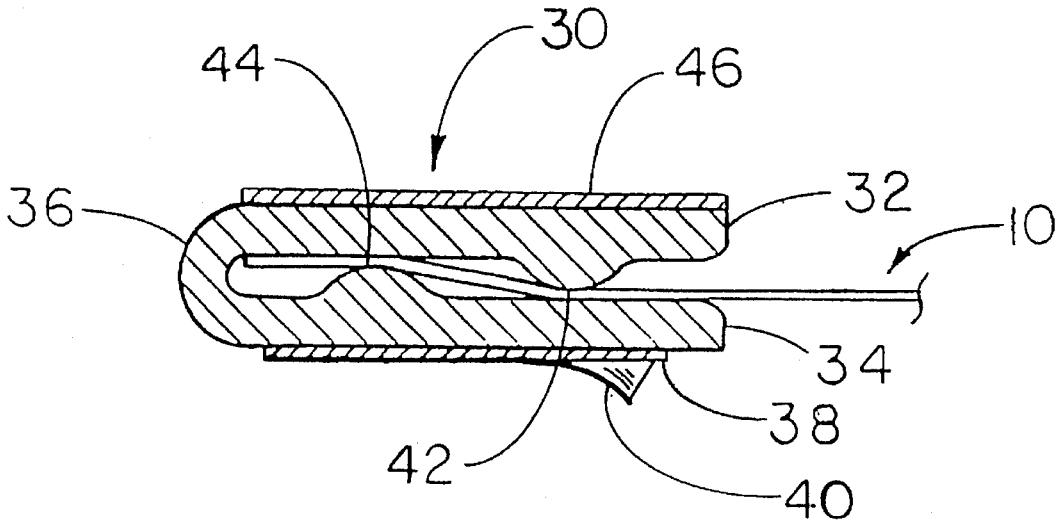
FIG. 4 is a side elevation to the device of FIG. 2 showing a flat object which is inserted into the device and, thereby, securely retained.
Figure 5:
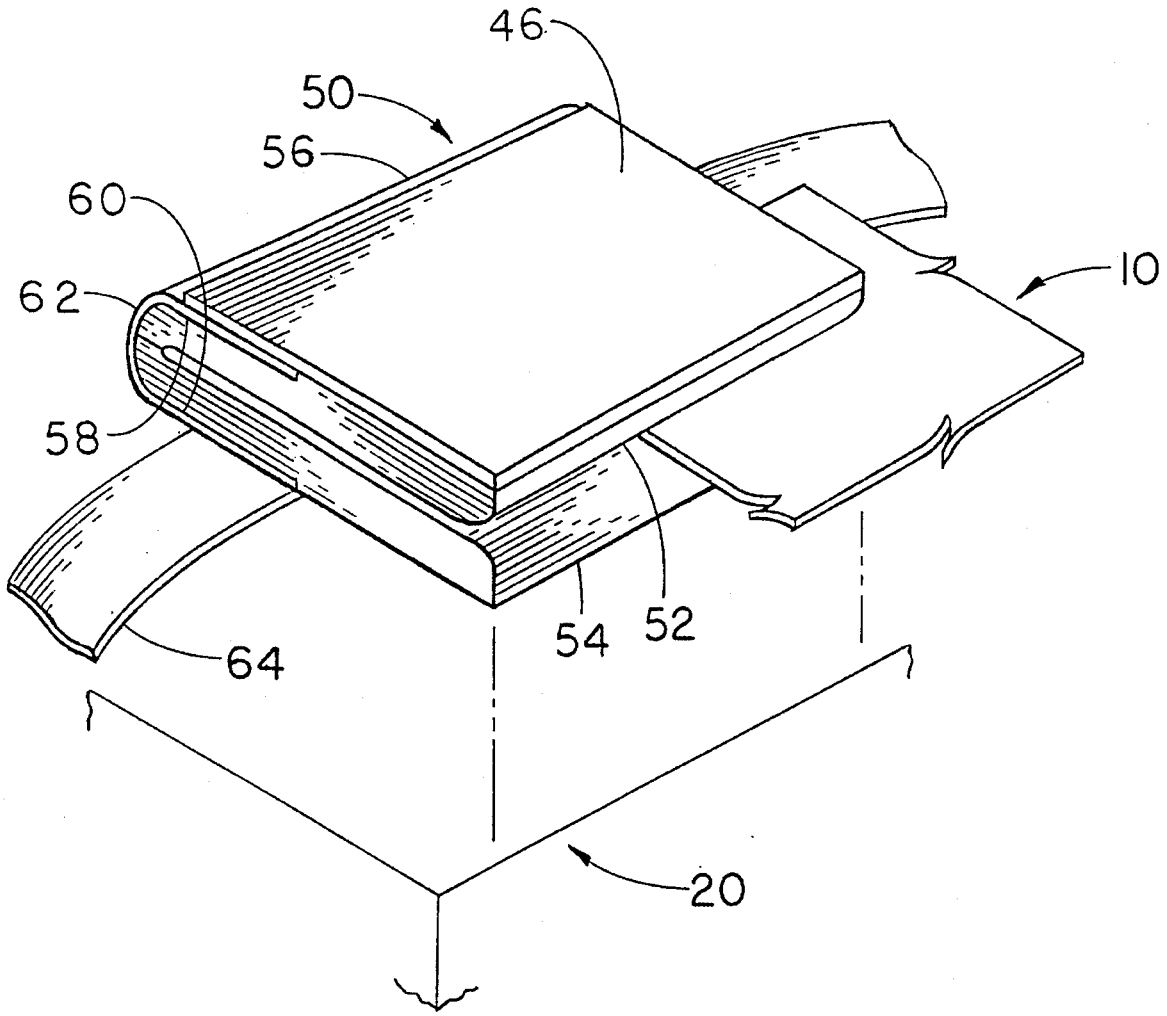
FIG. 5 is a perspective view of an alternate embodiment of the device of FIG. 2.
Figure 6A:
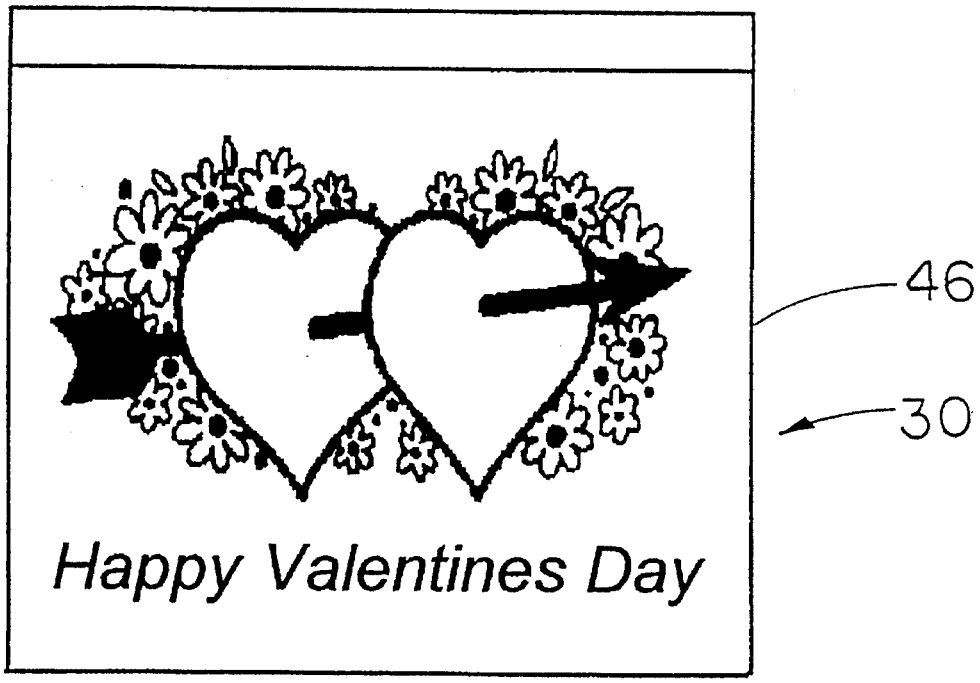
FIGS. 6A and 6B are top plan views of the device of FIG. 2 showing some specific examples of ornamental and functional designs that may be superposed onto or integral with the ornamental face of the device.
Figure 6B:
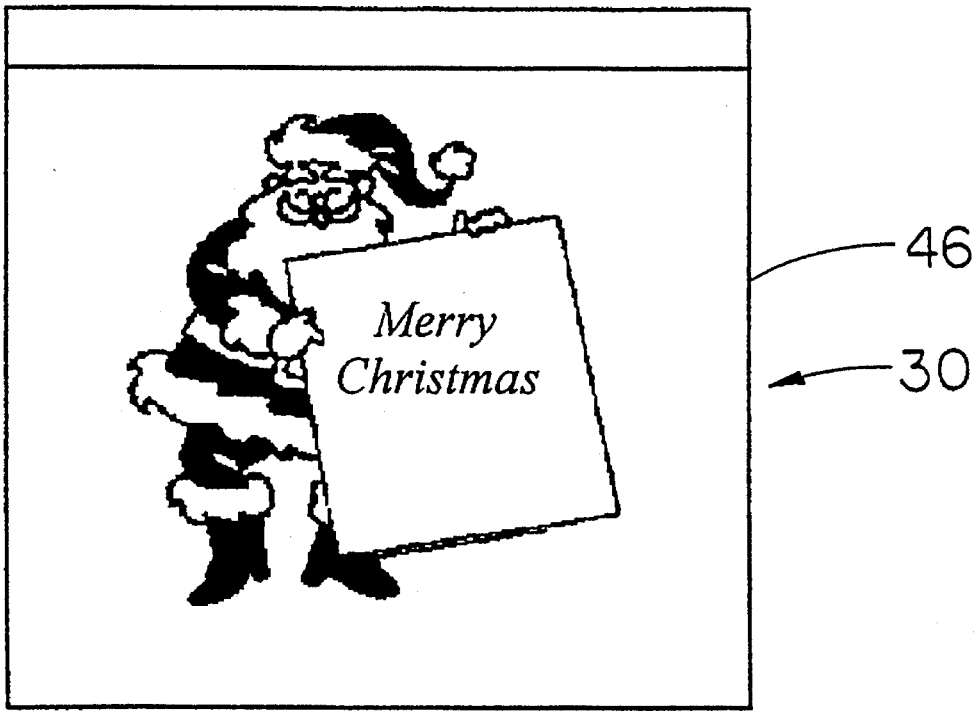

The structure of the preferred embodiment of the releasably securing and retaining device of the present invention, hereafter referred to as gripping device 30, is shown in FIGS. 2, 3, and 4. FIG. 5 shows a perspective view of an alternate embodiment of gripping device 30. FIG. 1 shows gripping device 30 in use. FIGS. 6A and 6B show specific examples of ornamentation applied to gripping device 30. Gripping device 30 may be manufactured in different sizes. Approximate dimensions are specified below for one of these sizes deemed suitable for a commonly sized gift card.

As seen from FIGS. 2 and 4, the side elevation of gripping device 30 is U-shaped. The two walls, or side members 32 and 34 of gripping device 30 are essentially planar. The outside face of side member 32 is used for incorporation of ornamental designs. The outside face of side member 34 is used for incorporation of a layer of adhesive material 38 which allows attachment of gripping device 30 to gift package 20. The U-shaped body of gripping device 30 is formed by molding or extrusion of a resilient plastic material in such a way that side members 32 and 34 urge resiliently toward each other. Side member 32 has overall dimensions which are equal to the corresponding dimensions of side member 34. The longitudinal dimension (from the outside surface of integral joint 36 at the closed end of gripping device 30 to the open end of gripping device 30) of either side member 32 or 34 is roughly from 30 mm to 50 mm. The lateral dimension of either side member 32 or 34 is also roughly from 30 mm to 50 mm. Thus, either side member 32 or 34, when viewed in plan, is square or rectangular in shape and has overall dimensions which are roughly 30 mm to 50 mm×30 mm to 50 mm.

The thickness of side member 32, is roughly equal to the thickness of side member 34 and has a dimension of roughly 3.0 mm to 5.0 mm. The height of the gap between side members 32 and 34, as measured when side members 32 and 34 are positioned so as to be exactly parallel, is roughly equal to the thickness of either side member 32 or 34 and is, therefore, 3.0 mm to 5.0 mm. The cross section of either side member 32 or 34, which is shown in FIG. 4, is of constant thickness with the exception of a portion of the cross section which varies in thickness so as to form protrusion 42 on side member 32 and protrusion 44 on side member 34. The cross section of either protrusion 42 or 44, which is shown in FIG. 4, is uniform when viewed at any point along the length of either protrusion 42 or 44. For protrusion 44, this is shown in FIG. 3. The boundary of any cross section (taken from the view of FIG. 4) of either protrusion 42 or 44 is a circular arc whose radius is approximately 50% greater than the height of the gap between side members 32 and 34 and is, therefore, 4.5 mm to 7.5 mm.

With nothing inserted into gripping device 30, protrusion 42 is in contact with the inside face of side member 34, as side members 32 and 34 urge resiliently together. The height, with respect to the inside face of side member 32, of that portion of protrusion 42 which is in contact with the inside face of side member 34 is roughly 1.0 mm less than the height of the gap between side members 32 and 34 (when exactly parallel) and is, therefore, 2.0 mm to 4.0 mm. The height of the corresponding portion of protrusion 44, with respect to the inside face of side member 34, is roughly 2.0 mm less than the height of the gap between side members 32 and 34 (when exactly parallel) and is, therefore, 1.0 mm to 3.0 mm. Therefore, with nothing inserted into gripping device 30, and while protrusion 42 is in contact with the inside face of side member 34, the height of the gap between protrusion 44 and the inside face of side member 32 is roughly 1.0 mm.

For either side member 32 or 34, its associated protrusion 42 or 44 is oriented laterally (perpendicular to the direction of insertion of flat object 10 into gripping device 30) and has the same lateral dimension, i.e. each end of either protrusion 42 or 44 is flush with the corresponding end of its associated side member 32 or 34. For protrusion 44, this is shown in FIG. 3.

In the preferred embodiment of the present invention, protrusions 42 and 44 are positioned in an offset arrangement with respect to each other. Protrusion 44 is part of side member 34, and protrudes toward side member 32. The distance from the inside surface of integral joint 36 to protrusion 44 is roughly 30% of the distance from the inside surface of integral joint 36 to the open end of gripping device 30. Protrusion 42 is part of side member 32 and protrudes toward side member 34. The distance from the inside surface of integral joint 36 to protrusion 42 is roughly 80% of the distance from the inside surface of integral joint 36 to the open end of gripping device 30.

The outside boundary of the cross section of integral joint 36 shown in FIG. 4, taken at any point along the length of integral joint 36, approximately describes a circular arc. The inside boundary of any such cross section of integral joint 36 also approximately describes a circular arc.

The inside faces of side members 32 and 34 are rounded at the open end of gripping device 30, as shown in FIGS. 2, 3, and 4.

Ornamentation is provided on the outside face of ornamental side member 32 and may be laminated onto or adhered to side member 32, as shown in FIGS. 2, 3, and 4. Ornamental member 46 is shown in generic form in FIG. 2 with no specific form of ornamentation shown. Specific examples of ornamental and functional designs are illustrated in FIGS. 6A and 6B. Many other examples are possible. Typically, as shown in FIGS. 2, 3, and 4, the lateral and longitudinal dimensions of ornamental member 46 are approximately equal to the corresponding dimensions of the flat area of the outside face of ornamental side member 32. The thickness of ornamental member 46 may or may not be uniform and may be substantially less than (if, for example, it is a decal), to roughly equal to, the thickness of either side member 32 or 34.

Ornamentation may also be provided to gripping device 30 by molding an ornamental design as an integral part of side member 32, or by printing a design onto the outside face of side member 32.

To secure gripping device 30 to gift package 20, there is provided an adhesive layer 38 which is adhered to attaching side member 34. Adhesive layer 38 is approximately centered on the outside face of side member 34, is rectangular in shape, has a lateral dimension which is typically one half of to approximately equal to the lateral dimension of side member 34, and has a longitudinal dimension which is typically one half of to approximately equal to the longitudinal dimension of side member 34. A peelable liner 40 is provided to releasably and protectively overlay adhesive layer 38.

Additional embodiments are considered. For example, various gripping devices similar to the preferred embodiment described above but with a different number, location, and arrangement of protrusions are possible. For example, only one protrusion may be used to increase clamping pressure on an item to be retained and the protrusion may be located at a distance from the closed end of the gripping device which is roughly 50% to 80% of the distance from the closed end to the open end of the gripping device. Or the gripping device may have two protrusions which are not positioned in an offset arrangement as are protrusions 42 and 44. They may, instead, be located at directly opposing positions and at a distance from the closed end of the gripping device which is roughly 50% to 80% of the distance from the closed end to the open end of the gripping device. Such opposing protrusions may have equal corresponding dimensions and be sized so that the two side members of the gripping device are approximately parallel when there is a 1.0 mm gap between the protrusions. It may be appreciated that many other similar embodiments are possible. For example, no protrusions may be used, or a multitude of protrusions having various cross sectional geometries may be used and positioned in various arrangements.

Referring to the drawing, specifically to FIG. 5, another alternate embodiment is considered. The gripping device 50 shown in FIG. 5 uses no protrusions. Rather, side members 52 and 54 are spaced apart, with each normally urged toward the other, so as to securely retain inserted flat object 10, where the insertion of flat object 10 into gripping device 50 results in a wedging action of flat object 10 within side members 52 and 54. Side members 52 and 54 may normally be urged toward each other via the action of a pivotal engaging counteractive fulcrum means at a mechanical joint. FIG. 5 shows such a means as counteractive fulcrum means 56, having opposing, upper and lower wall members 58 and 60 that normally and resiliently urge together and which are integrally joined at closed end 62. Ornamental side member 52 and non-ornamental side member 54 fit between upper and lower wall members 58 and 60 so as to be frictionally held in place. Ornamental member 46 may be affixed to ornamental side member 52.

Also shown in FIG. 5 is a non-adhesive attachment means 64. Rather than an adhesive layer, a decorative ribbon or flexible band or string is affixed to the outside face of lower wall member 60 or non-ornamental side member 54 by agglutinate or mechanical means. Gripping device 50 is then attached to gift package 20 by tying or stretching non-adhesive attachment means 64 around gift package 20.

Operation—FIG. 4

To secure gripping device 30 to gift package 20, peelable liner 40 is removed, gripping device 30 is positioned with adhesive layer 38 in proximity to gift package 20, and pressure is exerted on gripping device 30 against gift package 20, thereby securely attaching gripping device 30 to gift package 20.

After securement of gripping device 30 to gift package 20, flat object 10, which may be an envelope containing a greeting card, is inserted into gripping device 30 by positioning an edge of flat object 10 parallel to the line of contact between protrusion 42 and side member 34, orienting the plane of flat object 10 approximately parallel with the plane of either side member 32 or 34, and pushing flat object 10 toward integral joint 36 of gripping device 30. Insertion of flat object 10 into gripping device 30 is facilitated by the widened gap between side members 32 and 34 at the open end of gripping device 30. While flat object 10 is pushed into gripping device 30, an approximately equal force is exerted in the opposite direction by pushing with the other hand against integral joint 36. A gap is created between protrusion 42 and side member 34, owing to the resiliency of the plastic material of gripping device 30. This allows flat object 10 to be inserted between protrusion 42 and side member 34. When the inserted edge of flat object 10 reaches protrusion 44, the curved surface of protrusion 44, the ability of flat object 10 to deform and become non-planar, and continued pushing of flat object 10 toward integral joint 36, causes the gap between protrusion 44 and side member 32 to widen and allow passage of flat object 10 through it. Flat object 10 is pushed until its inserted edge comes to rest against the inside surface of integral joint 36. At this point, the position of flat object 10, now secured by gripping device 30 is as shown in FIG.4. Flat object 10 is securely retained in gripping device 30 as side members 32 and 34 urge resiliently toward each other. There results a strong clamping pressure against those areas of flat object 10 that are located between protrusion 44 and side member 32 and between protrusion 42 and side member 34. The clamping pressure on flat object 10 between protrusion 44 and 32 is approximately equal to the clamping pressure on flat object 10 between protrusion 42 and side member 34, owing to the gap of roughly 1.0 mm which exists between protrusion 44 and side member 32 when protrusion 42 is initially in contact with side member 34 before insertion of flat object 10. This initial gap between protrusion 44 and side member 32 of roughly 1.0 mm takes into account the thickness of a typical greeting card in an envelope and the flexing of side members 32 and 34 which occurs when an item such as flat object 10 is inserted into gripping device 30.

FIG. 4 shows flat object 10 fully inserted into gripping device 30. FIG. 4 also shows how the offset arrangement of protrusions 42 and 44 cause inserted flat object 10 to be deformed in such a way that the portion of it between integral joint 36 and protrusion 44, that portion of it between protrusions 44 and 42, and that remaining portion of it extending toward and beyond the open end of gripping device 30, lie in three different planes. This configuration makes it more difficult for an inserted item such as flat object 10 to rotate in the plane of gripping device 30 and, inadvertently become dislodged. FIG. 1 shows gripping device 30 in use, retaining flat object 10, which represents a gift card and the like, onto gift package 20.

Removal of flat object 10 from gripping device 30 is effected by manually pinching flat object 10 near the edge furthest from integral joint 36 and pulling in a direction away from integral joint 36 and parallel to the plane of gripping device 30. The resistance to removal of flat object 10 offered by gripping device 30 is not sufficient to cause gripping device 30 to become detached from gift package 20 when flat object 10 is removed.

SUMMARY, RAMIFICATIONS, AND SCOPE

From the description above it can be appreciated that the ornamental gripping device of this invention has a number of advantages over present methods for attaching and holding gift cards and the like onto gift packages. The gripping device of this invention can be manufactured easily and cheaply of resilient plastic material and is, therefore, affordable as a disposable item. It can be manufactured in a variety of colors, sizes, and shapes. It easily attaches to a gift package and easily accepts and retains a gift card and the like to such a package, and does so more securely than cellophane tape and other present methods. Multicolored designs in two or three dimensions can be incorporated as part of the gripping device so that it can have the dual function of retaining a gift card to a gift package and providing ornamentation and messages for a gift package. The ornamental features of the gripping device can eliminate the need for and cost of ornamentation presently used, such as ribbon, bows, and stickers. Also eliminated is the labor, time, and skill required to apply such presently used ornamentation to a gift package. The gripping device of this invention also allows for easy removal of a retained gift card and the like and in such a way that the gift card or envelope enclosing the gift card is not damaged. The gripping device also provides a more elegant and aesthetically pleasing means of attaching a gift card or the like to a gift package than does cellophane tape or other present methods. The ornamental gripping device is more resistant to damage such as the deformation that might be caused to bows during shipping, stacking, and general handling of gift packages.

Although the description above of this invention has been given with reference to a preferred embodiment, having certain approximate dimensions, and several specific alternate embodiments, it is not to be construed in a limiting sense. Many variations and modifications will now occur to those skilled in the art. For example, the gripping device can have other shapes, such as circular, oval, triangular, etc., and sizes. Also, the clamping force, rather than being provided by the resilient nature of the material used for the gripping device, may be provided by a torsion spring acting to urge together two hinged but otherwise unconnected halves, or by a counteractive fulcrum means such as that shown in FIG. 5. Also, as an alternative to adhesive layer 38, adhesive layers with shapes other than rectangular may be used. Also, there may be used ornamental members and integrally molded ornamental designs having dimensions and shapes differing from the dimensions and shapes of the ornamental side members of the gripping devices to which the ornamentation is affixed.

Thus, the scope of the invention should be determined by the appended claims and their legal equivalents, rather than by the examples given.

What is claimed is:

1. An ornamental gripping device for releasing and holding a gift card to a gift package, comprising:

a. a U-shaped gripping device with first and second side members spaced apart and aligned in a parallel manner, said first and second side members being joined together at one end, said first and second side members capable of applying sufficient clamping force on said gift card when placed therebetween to thereby enable the gift card to be selectively attached to said gripping device, said first and second side members each having outside and inside surfaces;

b. an ornamental means located on said outside surface of said first side member; and, c. an adhesive means located on said outside surface of said second side member enabling said gripping device to be attached to said gift package.

2. An ornamental gripping device, as recited in claim 1, further including at least one protrusion located on said inside surface of said first side member or second side member, said protrusion capable of applying clamping force on the gift card when placed between said first and second side members.

3. An ornamental gripping device, as recited in claim 1, wherein said ornamental means is an adhesively attached label with an ornamental outside surface.

4. An ornamental gripping device, as recited in claim 1, wherein said ornamental means is decorative artwork created directly on said outside surface of said first side member.

5. An ornamental gripping device, as recited in claim 1, wherein said adhesive means is a layer of adhesive material disposed on said outside surface of said second side member to enable said gripping device to be attached to the gift package.

6. A method for selectively attaching a gift card to a gift package, comprising the following steps:

a. selecting an ornamental gripping device which includes a U-shaped gripping device with first and second side members aligned in a parallel manner and joined together at one end, said first and second side members each having an outside surface, said first and second side members capable of applying sufficient clamping force on a gift card when placed therebetween to enable said gift card to be selectively attached to said first side member having an ornamental outside surface and said second side member having an outside adhesive layer;

b. attaching said adhesive layer on said gripping device to a gift package; and, c. attaching said gift card between said first and second side members of said gripping device to selectively attach said gift card to said gift package.

* * * * *